US006085662A

United States Patent [19]

Nilsson

[11] Patent Number: 6,085,662

[45] **Date of Patent: *Jul. 11, 2000**

[54] SPIN STABILIZED PROJECTILE WITH METAL BAND

[75] Inventor: Yngve Nilsson, Strängnäs, Sweden

[73] Assignee: Försvarets Forskningsanstalt, Stockholm, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 09/051,196

[22] PCT Filed: Oct. 3, 1996

[86] PCT No.: PCT/SE96/01258

§ 371 Date: Apr. 3, 1998

§ 102(e) Date: Apr. 3, 1998

[87] PCT Pub. No.: WO97/13113

PCT Pub. Date: Apr. 10, 1997

[30] Foreign Application Priority Data

Oct. 3, 1995 [SE] Sweden ..... 9503423

[51] Int. Cl.[7] ..... F24B 14/02

[52] U.S. Cl. ..... 102/526

[58] Field of Search ..... 102/489, 517, 102/524–528; 29/1.2–1.23

[56] References Cited

U.S. PATENT DOCUMENTS

| | | | |
|---|---|---|---|
| 998,712 | 7/1911 | McNair | 102/526 |
| 1,408,148 | 2/1922 | Tucker | 102/517 |
| 1,444,335 | 2/1923 | Cox | 102/526 |
| 3,838,497 | 10/1974 | Rizzitano et al. | 102/526 |
| 3,999,486 | 12/1976 | Bower | 102/526 |
| 4,532,868 | 8/1985 | Gleichaut et al. | 102/527 |
| 4,873,416 | 10/1989 | Boder | 219/121.64 |
| 5,078,054 | 1/1992 | Ashok et al. | 102/524 |
| 5,449,874 | 9/1995 | Altenau | 219/76.12 |

FOREIGN PATENT DOCUMENTS

| | | | |
|---|---|---|---|
| 32260 | 7/1981 | European Pat. Off. | 102/524 |
| 4039956 | 6/1992 | Germany | 102/526 |
| 441305 | 9/1985 | Sweden . | |

*Primary Examiner*—Harold J. Tudor

*Attorney, Agent, or Firm*—Jacobson, Price, Holman & Stern, PLLC

[57] ABSTRACT

The invention concerns a spin-stabilized projectile provided with a metal band (4). The projectile comprises a projectile body divided into a front main portion (1) and a rear main portion (2). The main portions are joined at the stern part of the projectile by means of a joint (3). The band is soldered or brazed with its inner surface and front flank surface onto an essentially cylindrical surface (6) and a rearwardly directed annular flank surface (5) of a shoulder which is formed in the rear end of the front main portion and extends round the projectile and which preferably has a length which is the same as the width of the band.

7 Claims, 2 Drawing Sheets

SPIN STABILIZED PROJECTILE WITH METAL BAND

TECHNICAL FIELD

The invention relates to a spin-stabilised projectile, provided with a band. The body of the projectile consists of two main portions which are joined by means of a joint at the stern part of the projectile, where the band is attached to the projectile body. The band is made of a metal alloy which is softer than the material of the projectile body, e.g. a copper alloy.

PRIOR ART

Spin-stabilised projectiles are usually provided with a band of a softer alloy, e.g. copper, for sealing against propellant gases and for imparting a spin to the projectile. When the projectile begins to be advanced through a rifled barrel, grooves are pressed into the band by the rifle ridges which then act as guides for the grooves. As the projectile is accelerated through the bore, the helical rifle ridges force the band and thus the projectile to spin. The indisposition, caused by the spin acceleration, to spinning of the projectile results in great stress between the band and the projectile body. In a conventional fashion, the band is fixed in a groove turned in the projectile body. The band is shrunk by being pressed radially inwards to embossing of the material so as to get a firm grip which is improved by the bottom of the groove being formed with driving flutes, into which the band material is pressed.

Recently, one has begun to use weapons for projectiles acting with kinetic energy. Since this action is dependent on the mass and striking speed of the projectile, these weapons are used together with heavier projectiles and a higher firing speed than in prior-art technique. A higher firing speed is also desired for an increased firing range. Owing to the higher trajectory speed, a higher speed of spinning of the projectile is required for maintained stability. A higher spinning speed is also obtained when older barrels with unchanged rifles are used at an increased firing speed. To make it possible to obtain a higher spinning speed at an unchanged or relatively small increase of the length of the barrel, it is necessary for the spinning of the projectile to accelerate more when driven through the barrel as compared with firing according to earlier technique.

By increasing the mass as well as the spinning acceleration of the projectile, the stresses in the connection between the band and the projectile body, which are caused by the above-mentioned factors, have increased significantly. The stresses have become so great that bands fixed according to prior-art technique have lost their hold and slid in their grooves of the above-mentioned type.

SUMMARY OF THE INVENTION

Technical problem

The object of the invention is to provide a spin-stabilised projectile with a metal band as mentioned by way of introduction. The projectile has, inter alia, the following properties:

improved fixing of the metal band rational manufacture of the projectile

Solution

This object is achieved by the projectile of the present invention.

A metal band usually is of essentially rectangular cross-section. The boundary surface consists of four surfaces: Inner and outer surface denominated according to the inner and outer diameter of the metal band as well as front and rear flank surface.

The invention suggests that the metal band be fixed by soldering or brazing to the front main portion of the projectile body. In order to accomplish a sufficiently strong connection, both the inner surface of the metal band and as much as possible of its front flank surface are used for soldering or brazing. These surfaces are fixed to the corresponding receiving surfaces of said front main portion, which are designed as a stepped shoulder extending round the stern of the main portion. This shoulder thus comprises a rearwardly directed flank surface and a substantially cylindrical surface extending astern at least as far as the width of the inner surface of the metal band. If the main portion extends further astern than the latter cylindrical surface, the protruding part does not have greater dimensions than to allow the metal band to be slipped onto this part up to the cylindrical surface.

Like in the alternative embodiment, this protruding part can be arranged with means for the joint of the type as will be mentioned below.

In the soldering or brazing operation, the band is arranged against this shoulder so as to form a slot having a suitable thickness, about 0.2 mm, between the surfaces. As a result, the fixing with, for instance, silver fillers as brazing material will be strong. The soldering or brazing is preferably carried out in such a manner that in any case the rear part of the entire front main portion is heated to the melting temperature of the soldering or brazing material.

According to the invention, it is also suggested that the projectile body be arranged such that, in the assembled state thereof, the rear main portion is arranged to extend into abutment against the rear flank surface of the band, or at least to the vicinity thereof at diameter which essentially corresponds to the diameter of the circumferential surface of the projectile. This can be carried out, for instance, by the rear main portion being provided with a forwardly directed annular flank surface having an outer diameter which essentially corresponds to the diameter of the shell of the projectile and which, at least in its outer annular part, is positioned, when the body is assembled, so as to abut against or in the vicinity of the rear flank surface of the band. This eliminates any unnecessary air resistance caused by the band.

The main portions are connected to each other by means of, for instance, a threaded joint, an overlap joint or fixing screws, for instance directed forwards from the stern. An overlap joint usually comprises a tubular part of the front or rear main portion. This tubular part is inserted with a fit inside a likewise tubular part of the other main portion. A joint may comprise some sort of guide means against spinning, e.g. splines together with break pins for locking in the axial direction. The main portions can also be soldered or brazed together. This joining can then be effected while the band is soldered or brazed on. The joining means can be comprised in the projectile ahead of the band inside this like in the preferred embodiment, or behind this like in the alternative embodiment.

Advantages

The fixing of the band withstands high loads, by the band having a large fixing surface to the projectile body and by this surface being partly arranged transversely of the direction of the resultant force from the pressure exerted by propellant gases on the rear flank surface of the band. This prevents this part of the fixing surface from being subjected to the shear stress that is caused by the propellant gases on cylindrical fixing surfaces and that is added to the shear stress caused by the above-mentioned indisposition to spinning of the projectile.

The band is fixed to the heaviest main portion of the projectile, which is favourable from the point of view of strength.

The band can be finished before being fixed. When fixing in prior-art manner, the band must be machined after being fixed by pressing, for instance by turning.

The projectile body is not subjected to the pressure arising if the band is fixed by pressing, which may complicate the manufacture especially of hollow projectile bodies. Nor is the projectile body subjected to local overheating like in resistance welding, which is detrimental from the point of view of strength.

DESCRIPTION OF THE FIGURES

A preferred embodiment will now be described in more detail with reference to the accompanying Figures, in which the reference numerals designate corresponding parts in both Figures.

PREFERRED EMBODIMENT

Figure 1:
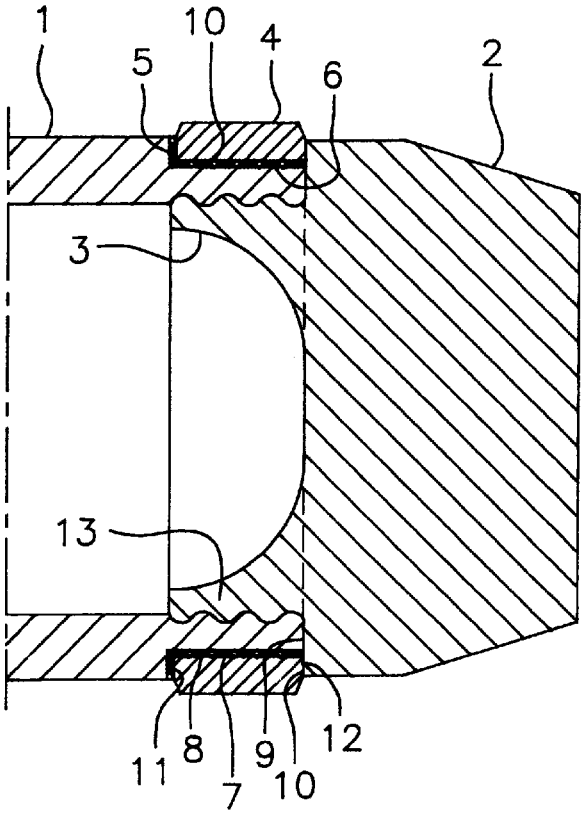
FIG. 1 is a longitudinal section of the rear part of a projectile body with a fixed band.

FIG. 1 illustrates the rear part of a load-carrying projectile comprising a hollow projectile body of forged steel, which is divided into a front main portion 1 and a rear main portion 2. The main portions are joined by means of a threaded joint 3, but could also be joined by means of, for instance, an overlap joint. A band 4 of a copper alloy is arranged on the projectile body in connection with the joint between the main portions.

A stepped shoulder is formed in the end of the front main portion. The shoulder consists of an annular flat flank surface 5 and a cylindrical surface 6, with a fillet in the transition between the surfaces. The band 4 is fixed by means of a brazing solder 7, such as a silver filler, to these surfaces. The band has an inner cylindrical surface 8 having a diameter exceeding that of the cylindrical surface 6 of the shoulder to such an extent that a brazing slot of 0.2–0.3 mm is obtained. The slot can be kept in the brazing operation by means of a brazing fixture or by the brazing surfaces of the band being provided, during manufacture of the band, with knobs 16, or small projections. The cylindrical surface 6 of the shoulder is made so long that the abruptly cut-off, annular end face 9 of the front main portion and the flat annular rear flank 10 of the band reach astern to the same extent when the band has been brazed on. By means of, for instance, knobs, a brazing slot is obtained also between the flank surface 5 of the shoulder and the front flank 11 of the band.

The rear main portion is formed with an annular flat flank surface 12, whose outer diameter is slightly smaller than that of the flat flank surface 5 of the shoulder, and with a threaded cylinder 13 which is directed forwards from the area inside the flank surface and whose thread matches an inner thread formed in the end of the front main portion to constitute the threaded joint 3. After joining of the two main portions, the flank surface 12 of the rear main portion abuts against the end face 9 of the front main portion as well as the rear flank 10 of the band. This design results in a very strong fixing of the band and an area, reinforced by the threaded joint inside the band, of a projectile body portion which is subjected to great stresses. These stresses arise, for instance, when the grooves are pressed into the band in the firing of the projectile.

Figure 2:
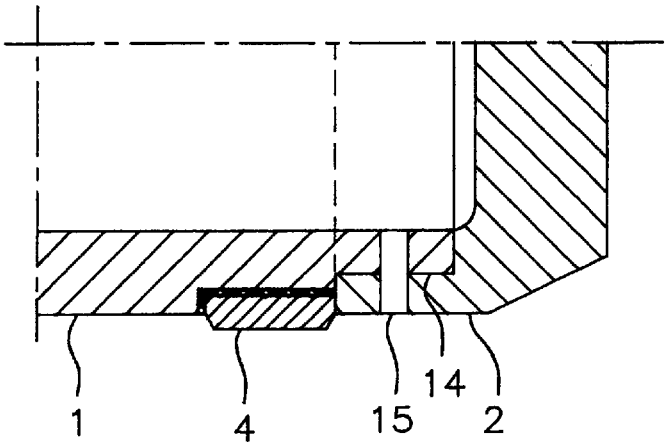
FIG. 2 is a longitudinal section of the rear part of an alternative embodiment of a projectile body with a fixed band.

FIG. 2 illustrates the rear part of an alternative projectile body which is also divided into a front main portion 1 and a rear main portion 2. The main portions are joined by means of an overlap joint 14, locked by a number of breakable pins 15. The projectile can be used, for instance, as carrier of subwarheads, which are discharged in flight from the front main portion 1 after blasting away of the rear main portion 2. A band 4 is fixed by brazing to the front main portion in the same fashion as in the main embodiment.

Figure 3:
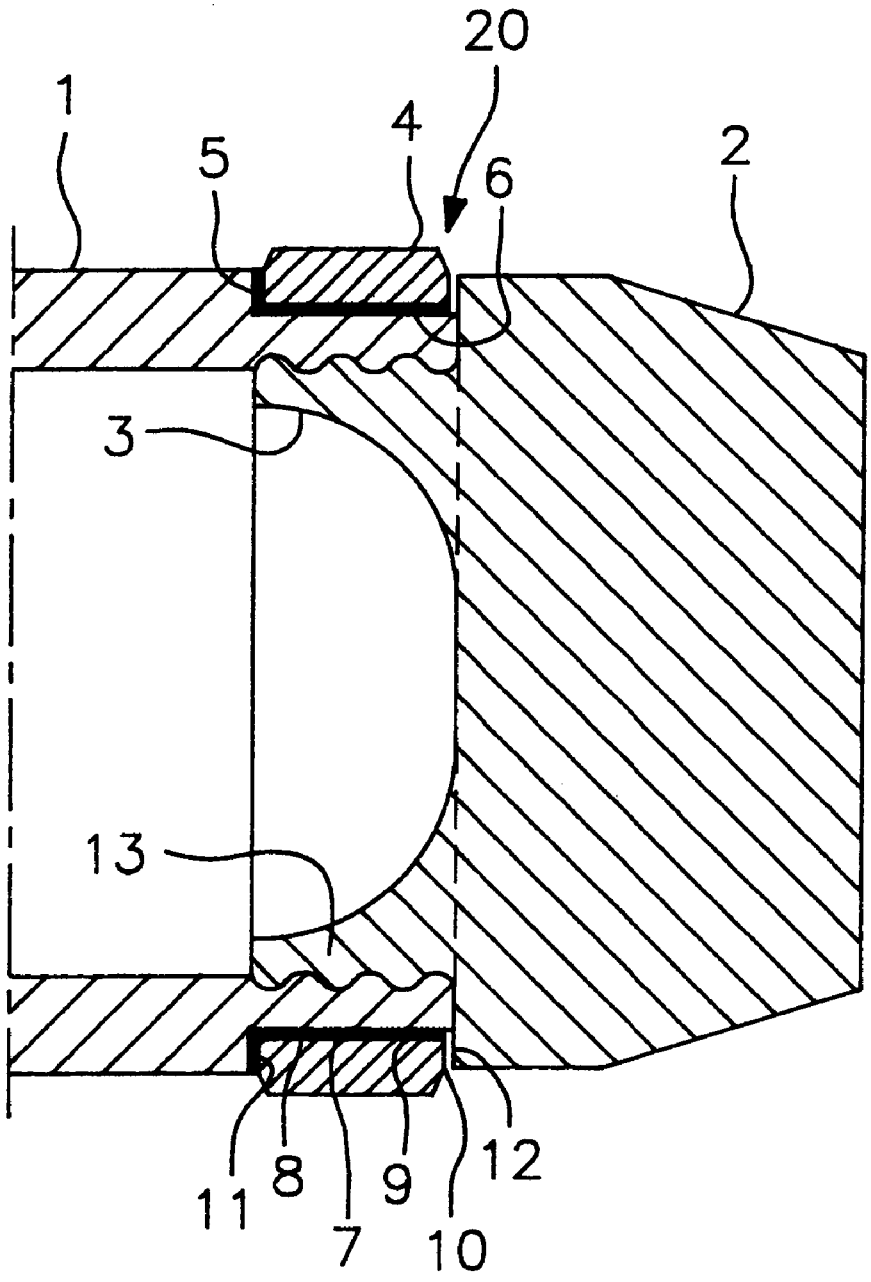
FIG. 3 is a longitudinal section of the rear part of a projectile body with a fixed band, showing a gap between a rear flank surface of a band and a forwardly directed annular flank surface of a rear main portion.

In FIG. 3, rear flank 10 of the band 4 extends to the vicinity of flank surface 12 of the rear main portion 2 to form a gap 20 located between rear flank 10 and flank surface 12. In gap 20 there are no connections between rear flank 10 and surface 12.

What is claimed is:

1. A spin stabilized projectile comprising:

a projectile body with a front main portion and a rear main portion joined by a joint, the front main portion having a rearwardly directed annular flank surface and a substantially cylindrical surface at a stern end, the substantially cylindrical surface having a first diameter; and a preformed solid band having a substantially cylindrical inner surface, a rear flank surface and a front flank surface, the inner surface defining a second diameter larger than the first diameter such that said solid band is slipped over the stern end of said front main portion;

an L-shaped slot defined between the substantially cylindrical surface of the front main portion and the inner surface of the band arid between the front flank surface of said band and the rearwardly directed annular flank surface of the front main portion so that said inner surface is securely attached by one of soldering and brazing in the slot to the substantially cylindrical surface of said front main portion, and the front flank surface of said band is securely attached by one of soldering and brazing in the slot to the rearwardly directed annular flank surface of said front main portion, said soldering or brazing being only in said slot;

said rear main portion being joined to said front main portion after said band has been slipped over the stern end of said front main portion and securely attached thereto;

said rear main portion having a forwardly directed annular flank surface extending in the vicinity of the rear flank surface of the band which forms a gap between the forwardly directed annular flank surface and the rear flank surface of the band in the absence of any connection including one of soldering and brazing for reducing air resistance caused by the band.

2. The spin-stabilized projectile as claimed in claim 1 wherein, when said band is slipped over the stern end of said front main portion and, the slot between the substantially cylindrical surface of the front main portion and the inner surface of the band is approximately 0.2 mm to 0.3 mm.

3. The spin-stabilized projectile as claimed in claim 1 wherein, when said band is slipped over the stern end of said front main portion, and the slot between the front flank surface of said band and the rearwardly directed annular flank surface of the front main portion is approximately 0.2 mm to 0.3 mm.

4. The spin-stabilized projectile as claimed in claim 2, wherein said band includes a plurality of knobs on the inner surface to form the slot between the substantially cylindrical surface of the front main portion and the inner surface of the band.

5. The spin-stabilized projectile as claimed in claim 1, further comprising a plurality of knobs on the front flank surface of said band in the slot between the front flank surface of said band and the rearwardly directed annular flank surface of the front main portion.

6. A spin stabilized projectile comprising:

a projectile body with a front main portion and a rear main portion joined by a joint, the front main portion having a stern end with a first attaching surface substantially transverse to a result-ant force from pressure exerted by propellant gases on said projectile body, and a second substantially cylindrical attaching surface, said second attaching surface having a first diameter;

a preformed solid band having a substantially cylindrical inner surface, a front flank surface and a rear flank surface, the inner surface defining a second diameter larger than the first diameter such that said preformed solid band is slipped onto the stern end of said projectile body from behind; and an L-shaped slot of approximately 0.2 mm to 0.3 mm located between the inner surface of said preformed solid band and the second substantially cylindrical attaching surface of the projectile body and between the front flank surface of said band and the first attaching surface of the projectile body;

said solid band being securely attached through one of soldering and brazing in said slot to the stern end of said projectile body along only said first attaching surface and said second attaching surface;

said rear flank surface of said band extending in the vicinity of said rear main portion of said projectile body which forms a aap between said rear flank surface of said band and said rear main portion of said projectile body in the absence of any connection including one of soldering and brazing for reducing air resistance caused by said band.

7. The spin-stabilized projectile as claimed in claim 6, further comprising a plurality of knobs on the inner surface of the bank in the slot between the second diameter and the first diameter.

* * * * *